US008516628B2

(12) United States Patent
Conroy

(10) Patent No.: US 8,516,628 B2
(45) Date of Patent: Aug. 27, 2013

(54) FLOW CONTROL APPARATUS AND METHOD

(75) Inventor: Patrick Conroy, Suffolk (GB)

(73) Assignee: Touchtile Ltd, Cambridge (GB)

( * ) Notice: Subject to any disclaimer, the term of this patent is extended or adjusted under 35 U.S.C. 154(b) by 840 days.

(21) Appl. No.: 11/792,461

(22) PCT Filed: Dec. 6, 2005

(86) PCT No.: PCT/GB2005/050235
§ 371 (c)(1),
(2), (4) Date: Mar. 20, 2008

(87) PCT Pub. No.: WO2006/061657
PCT Pub. Date: Jun. 15, 2006

(65) Prior Publication Data

US 2009/0119832 A1 May 14, 2009

(30) Foreign Application Priority Data

Dec. 7, 2004 (GB) ..... 0426807.4

(51) Int. Cl.
*E03C 1/05* (2006.01)

(52) U.S. Cl.
USPC ..... 4/623; 4/559

(58) Field of Classification Search
USPC ..... 4/559, 623; 251/129.04; 245/173–184; 178/18.1–20.04; 348/14.03
See application file for complete search history.

(56) References Cited

U.S. PATENT DOCUMENTS

| | | | | |
|---|---|---|---|---|
| 4,567,350 | A * | 1/1986 | Todd Jr. | 392/486 |
| 5,033,508 | A * | 7/1991 | Laverty, Jr. | 137/624.11 |
| 5,887,118 | A * | 3/1999 | Huffman et al. | 392/390 |
| 2002/0148040 | A1 | 10/2002 | Mateina | |
| 2003/0112228 | A1 * | 6/2003 | Gillespie et al. | 345/173 |
| 2003/0189552 | A1 * | 10/2003 | Chuang et al. | 345/173 |
| 2003/0210235 | A1 * | 11/2003 | Roberts | 345/173 |
| 2003/0234769 | A1 * | 12/2003 | Cross et al. | 345/173 |
| 2004/0201579 | A1 * | 10/2004 | Graham | 345/175 |
| 2004/0239650 | A1 * | 12/2004 | Mackey | 345/174 |
| 2007/0069169 | A1 * | 3/2007 | Lin | 251/129.04 |

FOREIGN PATENT DOCUMENTS

| | | | |
|---|---|---|---|
| DE | 3514640 | A1 | 10/1986 |
| DE | 3812736 | C1 | 1/1989 |
| DE | 10055061 | C1 | 7/2002 |
| DE | 10332708 | B3 | 1/2005 |
| WO | WO 8909956 | A1 * | 10/1989 |

OTHER PUBLICATIONS

Stumpe, A New Principle for an X-Y Touch Screen, Mar. 16, 1977.*

* cited by examiner

*Primary Examiner* — Len Tran
*Assistant Examiner* — Viet Le
(74) *Attorney, Agent, or Firm* — Wolf, Greenfield & Sacks, P.C.

(57) ABSTRACT

The present invention relates to a touch or proximity sensitive device, specifically one which controls characteristics such as the temperature and flow rate of water or other liquids. An apparatus for controlling a flow characteristic of a flowing liquid by a user, the apparatus comprising a two-dimensional control surface for sensing the proximity of a user in two dimensions, means for determining a position of the user, and means for controlling the characteristic of the liquid responsive to said determining.

3 Claims, 20 Drawing Sheets

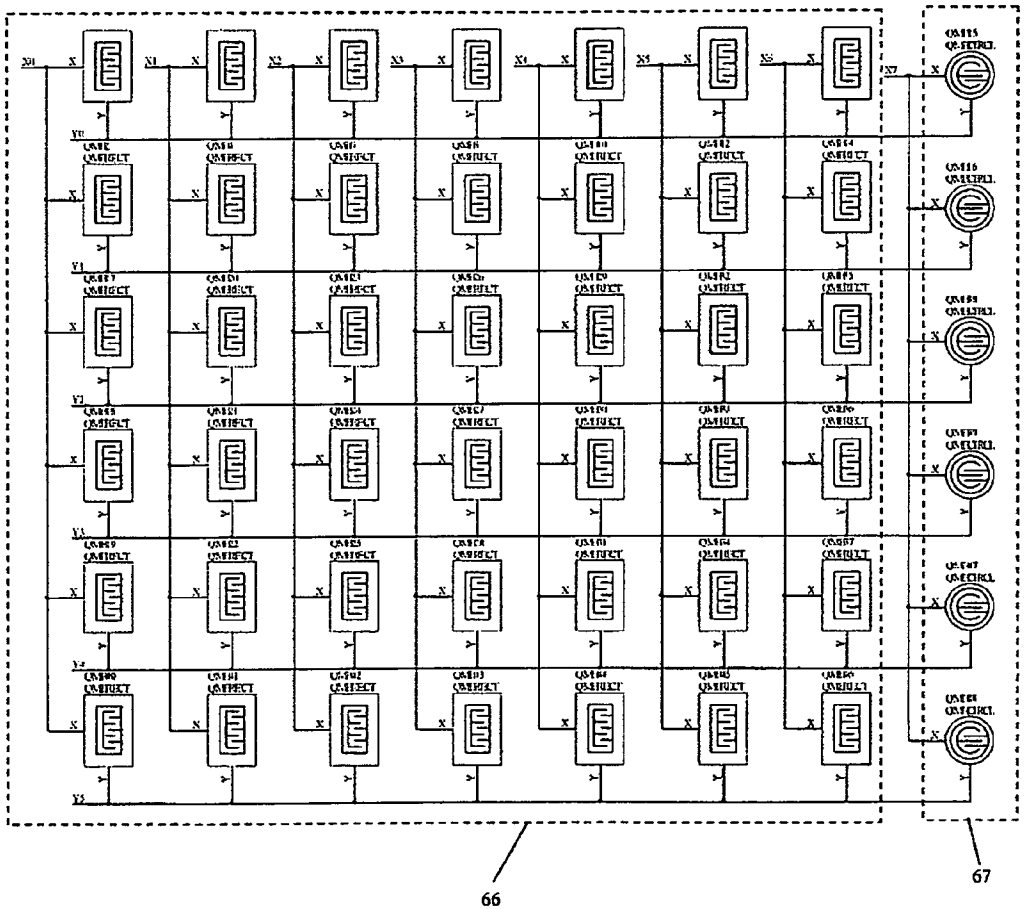
Figure 24
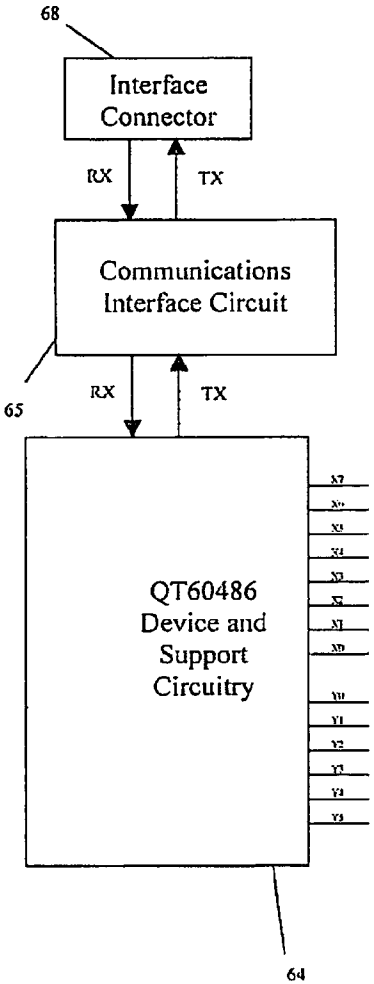

X Axis

SLOW

COLD

HOT

Y Axis

| | 1 | 2 | 3 | 4 | 5 | 6 | 7 |
|---|---|---|---|---|---|---|---|
| 1 | Cold 25%<br>Hot 0% | Cold 20.83%<br>Hot 4.17% | Cold 16.67%<br>Hot 8.33% | Cold 12.5%<br>Hot 12.5% | Cold 8.33%<br>Hot 16.67% | Cold 4.17%<br>Hot 20.83% | Cold 0%<br>Hot 25% |
| 2 | Cold 50%<br>Hot 0% | Cold 41.67%<br>Hot 8.33% | Cold 33.33%<br>Hot 16.67% | Cold 25%<br>Hot 25% | Cold 16.67%<br>Hot 33.33% | Cold 8.33%<br>Hot 41.67% | Cold 0%<br>Hot 50% |
| 3 | Cold 75%<br>Hot 0% | Cold 62.5%<br>Hot 12.5% | Cold 50%<br>Hot 25% | Cold 37.5%<br>Hot 37.5% | Cold 25%<br>Hot 50% | Cold 12.5%<br>Hot 62.5% | Cold 0%<br>Hot 75% |
| 4 | Cold 100%<br>Hot 0% | Cold 83.33%<br>Hot 16.67% | Cold 66.67%<br>Hot 33.33% | Cold 50%<br>Hot 50% | Cold 33.33%<br>Hot 66.67% | Cold 16.67%<br>Hot 83.33% | Cold 0%<br>Hot 100% |

FAST

Figure 29

X Axis

SLOW

COLD

HOT

Y Axis

| | 1 | 2 | 3 | 4 | 5 | 6 | 7 |
|---|---|---|---|---|---|---|---|
| 1 | Cold 25%<br>Hot 0% | Cold 25%<br>Hot 8.33% | Cold 25%<br>Hot 16.67% | Cold 25%<br>Hot 25% | Cold 16.67%<br>Hot 25% | Cold 8.33%<br>Hot 25% | Cold 0%<br>Hot 25% |
| 2 | Cold 50%<br>Hot 0% | Cold 50%<br>Hot 16.67% | Cold 50%<br>Hot 33.33% | Cold 50%<br>Hot 50% | Cold 33.33%<br>Hot 50% | Cold 16.67%<br>Hot 50% | Cold 0%<br>Hot 50% |
| 3 | Cold 75%<br>Hot 0% | Cold 75%<br>Hot 25% | Cold 75%<br>Hot 50% | Cold 75%<br>Hot 75% | Cold 50%<br>Hot 75% | Cold 25%<br>Hot 75% | Cold 0%<br>Hot 75% |
| 4 | Cold 100%<br>Hot 0% | Cold 100%<br>Hot 33.33% | Cold 100%<br>Hot 66.67% | Cold 100%<br>Hot 100% | Cold 66.67%<br>Hot 100% | Cold 33.33%<br>Hot 100% | Cold 0%<br>Hot 100% |

FAST

Figure 30

FLOW CONTROL APPARATUS AND METHOD

CROSS-REFERENCE TO RELATED APPLICATIONS

This application is a 35 U.S.C. § 371 National Stage Application of International Application No. PCT/GB2005/050235, filed Dec. 6, 2005, which claims the benefit of Great Britain Application No. GB0426807.4, filed. Dec. 7, 2004.

The present invention relates to a touch or proximity sensitive device, specifically one which controls characteristics such as the temperature and flow rate of water or other liquids.

Faucets already control the flow rate of hot and cold water as standard fittings for baths, showers, kitchen sinks and basins. These devices require the user to operate at least one faucet valve in order to release water flow at the temperature and flow rate desired by a user. The usual feedback mechanism the user has of the flow rate and temperature is to use one hand to feel these two factors and then turn one or more faucet valves until the desired temperature and flow rate has been achieved.

There are many instances where people have difficulty using standard faucets. People who have difficulty using standard faucet valve levers such as those with arthritis or those who don't have the motor skills to operate normal faucet valves, need special faucet valve levers installed in order to make it easier for them to turn water on and off. These special faucet controls still require manual operation and are not suited to all of these people. Places such as hospitals have long lever faucets installed in all of their basins in an attempt to cater for all people who may or may not have difficulty in operating standard faucets. All of these installations still require users to feel the temperature of the water if only briefly in order to make a decision whether that temperature and flow rate is acceptable to them.

Cleaning faucets and faucet valve levers whether in the home, hospitals, or any other industry can be a time consuming and sometimes difficult task if absolute cleanliness is required. All faucet installations are different in some way and all have different shapes with places that are hard to get to, especially if installed too close to an obstacle such as a wall.

Preferably a method would be found which attempts to resolve the problems explained above whereby a user can dispense water into a shower, bath, kitchen sink or basin using a proximity sensitive device.

Thus, according to an aspect of the present invention, there is provided an apparatus for controlling a flow characteristic of a flowing liquid by a user, the apparatus comprising a two-dimensional control surface for sensing the proximity of a user in two dimensions, means for determining a position of the user, and means for controlling the characteristic of the liquid responsive to said determining.

It would be advantageous to allow the single touch of a finger or toe to turn the flow of water on at a desired flow rate and control the percentage mixture of hot and cold water or the temperature of the water supplied by an on demand water heater. This may be achieved using a proximity sensor to detect the presence of a finger, toe or other limb in two dimensions; alternatively a touch sensor may be used. In the description that follows, where references are made to proximity sensors, it will be understood by those skilled in the art that touch sensors could also be utilized. The proximity sensor detects the presence of a user or a portion of the user and provides information regarding the position of the user or portion of the user with respect to the proximity sensor.

The control surface may alternatively comprise a control area, for example when the surface in front of the device comprises a bathroom tile placed over the device, the tile itself may be supplied separately from the device, or an existing bathroom tile may be re-used.

The device may control the flow rate of water, percentage mixture of hot and cold water or temperature of the water proportional to the determined position of the user. In systems where the proximity sensor comprises a number of sensors for sensing discrete positions along the sensor, the device may be configured to provide substantially continuous variation. With a large number of sensors, for example 6, 7 or 8, variation may be substantially continuous already. Alternatively, the device may interpolate between two sensed positions of the user, in order to increase the control resolution available.

Another advantage would be to allow ease of cleaning of the proximity sensitive temperature and flow rate control device.

The proximity sensitive device can be positioned behind a surface such as a work bench or wall, or integrated into an object such as a tile, bath, kitchen sink, faucet or basin. If a tile is used, it can be positioned amongst other tiles on a wall at an appropriate place for ease of use. If it is a later addition it can be positioned on top of an existing surface for example. This later addition could be battery operated and could be rechargeable, with wireless connectivity to the main control box. This would eliminate the need to physically connect a wired version of the proximity sensitive device to the control box which would involve building works.

The proximity sensitive water temperature and water flow control device could complement or replace faucets allowing the water flow and temperature to be controlled by touching a predetermined location on a surface rather than manually turning taps. The touch or proximity sensitive water temperature and water flow control device can use capacitive or inductive sensing technology, pressure sensing technology, resistive sensing technology as found on a touch screen display device, or any combination of these methods.

According to a second aspect of the present invention, there is provided an apparatus for controlling a flow rate of a flowing liquid by a user, the apparatus comprising a control strip for sensing the proximity of a user, means for determining a position of the user, and means for controlling the flow rate of the liquid responsive to said determining.

According to a third aspect of the present invention, there is provided a method of controlling a flow characteristic of a flowing liquid by a user operating a two-dimensional control surface, the method comprising sensing the proximity of the user in two dimensions using the control. Surface, determining a position of the user, and controlling the flow characteristic responsive to said determining.

An embodiment of the present invention controls the flow of water electrically using electronically controlled valves which may incorporate manual overriding features, to adjust the flow rate of hot or cold water from closed to fully open and any positions in between. In its most basic form the feedback mechanism telling the user the temperature and flow rate of the water, is the same as regular taps which is to feel the temperature and water flow rate. Feedback can be given to the user as a finger travels over the proximity sensitive surface area by lighting up LED's below the finger or changing the graphics of a display device to give an indication as to how the proximity sensitive device is responding.

The proximity sensitive area which controls the temperature and flow rate of water could be arranged as a sequence of proximity sensitive buttons within a square or rectangular matrix with two axes, x and y for example. One axis, the x axis for example, could allow the selection of hot or cold water and any temperature in between those two extremes and the y axis, for example, could allow the selection of a slow or fast flow rate and any flow rate in between those two extremes. The resolution of the two different axes can be determined by the number of buttons available in the matrix and any interpolation algorithms used to increase the resolution of the matrix.

The control unit which electrically controls the various valves can have multiple proximity sensitive devices connected to it. One such use of this type of system would be where there may be more than one convenient location to install a proximity sensitive device to control a single valve control unit. Alternatively, a single proximity sensitive device may be used to control more than one valve control unit. In one example, a proximity sensitive device may be used to control either a valve control unit for a shower or a valve control unit for a bath.

The proximity sensitive device communicates to a valve control device using a communications protocol such as RS232 or RS485 which interfaces in either a wired, optical or wireless way to the valve control device in order to instruct the valve control device of whether or not an area of the proximity sensitive surface has been activated, and if so, its position. It will then make decisions to control the valves and water heating device if one is present.

The proximity sensitive device could also be placed behind a display device such as an LCD graphics display which would allow the proximity sensitive area to be displayed graphically. This would also allow instant feedback as to what temperature and flow rate the user has selected. Alternatively, an LED display or other display technology may be used.

The proximity sensitive device or the control unit could also provide feedback to the user in an audible way. This may be useful if there is no visual feedback to the user from the proximity device or the control unit to indicate whether the unit is in the OFF mode or the ON mode.

The temperature of the water can also be controlled using a single row of buttons which would allow the temperature of the water to be adjusted. The water flow could be controlled by a similar mechanism or by individual buttons which give a limited number of water flow rates. The row of buttons could be made to be any shape such as a straight line or a curve or even a complete circle.

In order to clean the surface of the proximity sensitive device so that it doesn't turn water on it may be capable of being placed in an OFF state. This can be achieved by either placing a hand over the proximity sensitive area for a reasonable amount of time, or activating an OFF button for a reasonable amount of time. Indication of the OFF state may then be given to the user. In order to reactivate the functionality of the proximity sensitive device the device must be put back into the ON state. The ON state can be reinstated by either placing a hand over the proximity sensitive area for a reasonable amount of time, or activating an ON button for a reasonable amount of time. Indication of the ON state must then be given to the user to acknowledge the ON state.

According to a fourth aspect of the invention, there is provided a method of controlling a bath, shower, basin or sink, the method comprising moving a finger or other appendage near a two-dimensional control surface, whereby the control surface controls an apparatus configured to control a flow characteristic of a flowing liquid responsive to a determined position of the finger or other appendage.

These and other aspects of the present invention will now be further described, by way of example only, with reference to the accompanying drawings in which:

FIGS. 1*a* to 1*f* show a user's hand operating a tile incorporating a proximity-sensitive device for six different temperature and flow rates.

FIG. 24 shows a block diagram of a circuit suitable for use with a proximity-sensitive device.

FIG. 29 shows a first example of a table for translating location into water temperature and flow rate information.

FIG. 30 shows a second example of a table for translating location into water temperature and flow rate information.

FIGS. 1*a* to 1*f* depict the operation of a proximity sensitive tile 1 for six different temperature and flow rates. Each figure shows the water temperature is selected on the horizontal axis with cold on the left and hot on the right. The water flow rate is selected on the vertical axis with minimum flow rate at the top and maximum flow rate at the bottom. The figures are arbitrary and the axis and directions for the temperature and flow rate does not necessarily have to be as shown. Positioning the finger or toe up or down will decrease or increase the flow rate respectively indicated by the SLOW and FAST indicators. Positioning the finger or toe to the left or right in the proximity sensitive control matrix 2 will make the water colder or hotter depending on the location between the COLD and HOT sides of the proximity sensitive matrix 2. If positioned in the middle, the temperature will be an equal mixture of hot and cold water, or the mid point temperature of an on demand water heater. If a hand is placed flat against the control matrix 2 the unit will turn off the flow of water.

Figure 1A:
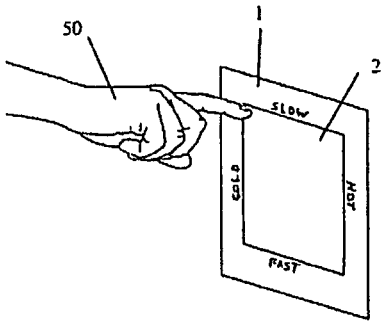
Figure 1B:
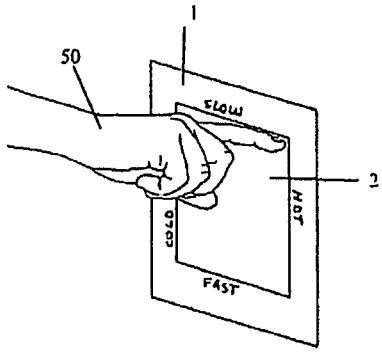
Figure 1C:
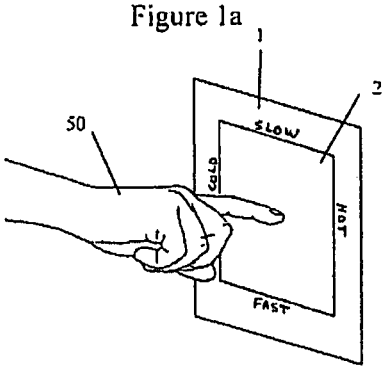
Figure 1D:
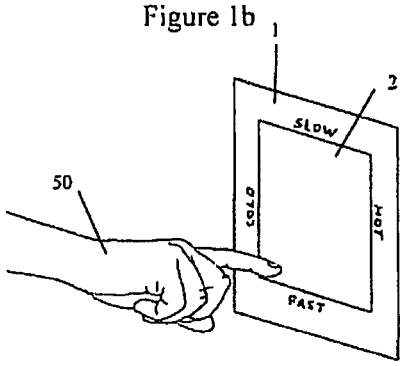
Figure 1E:
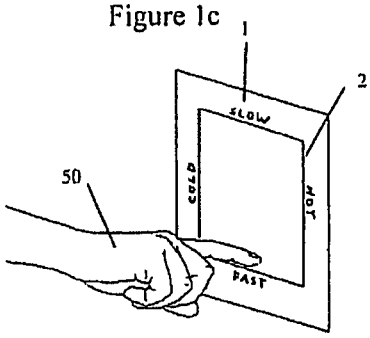
Figure 1F:
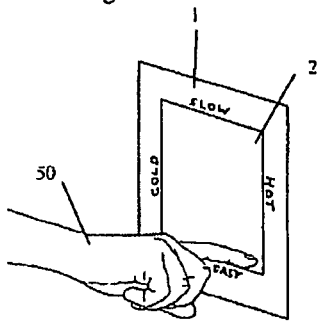
Figure 2:
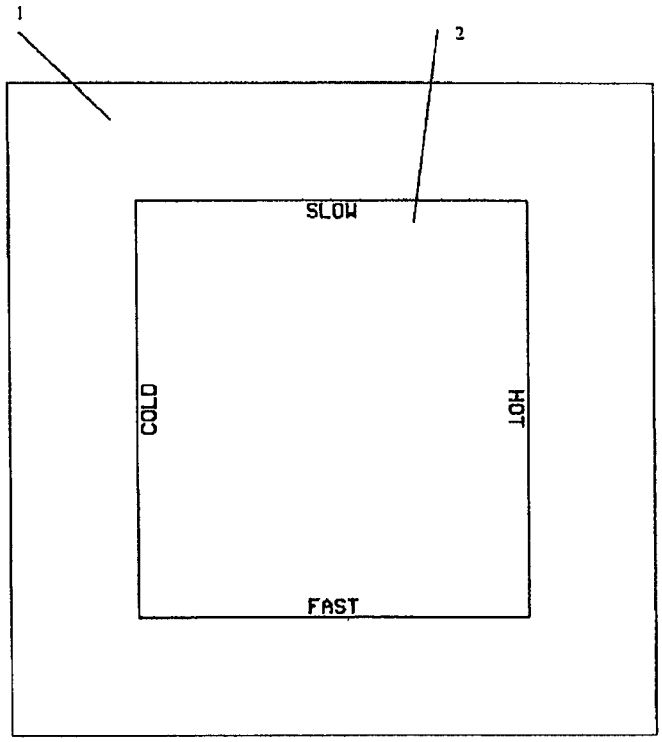
FIG. 2 shows a front view of a tile incorporating temperature and flow rate indications.
Figure 3:
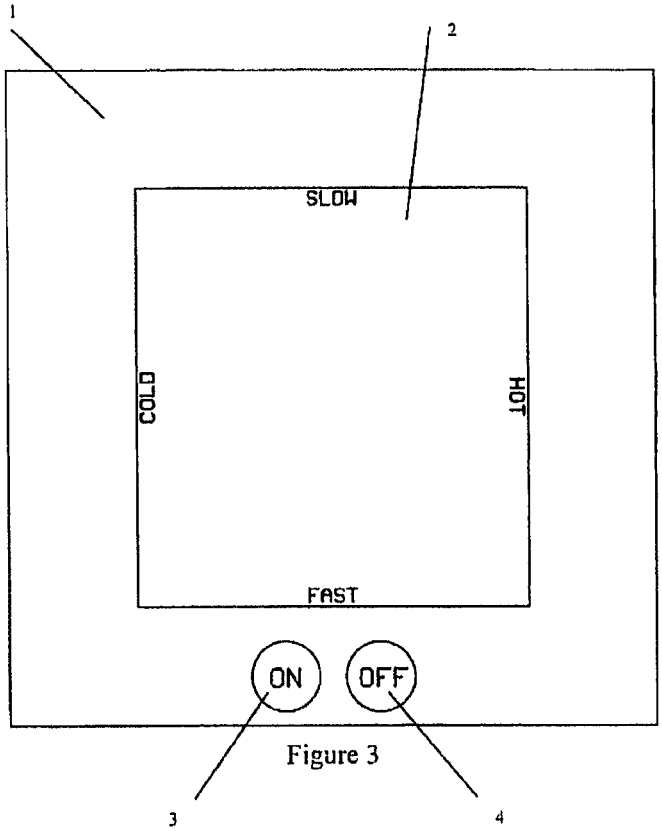
FIG. 3 shows a front view of a tile incorporating temperature, flow rate and on/off indications.

FIG. 1*a* shows a user's hand 50 selecting the minimum flow rate and cold water only;

FIG. 1*b* shows a user's hand 50 selecting the minimum flow rate and hot water only;

FIG. 1*c* shows a user's hand 50 selecting a flow rate of 50% the maximum and also a temperature which mixes cold and hot water equally. If the water is supplied from an on demand heating device the water temperature supplied in this instance would be the middle of the temperature scale available;

FIG. 1*d* shows a user's hand 50 selecting a maximum flow rate and cold water only;

FIG. 1*e* shows a user's hand 50 selecting a maximum flow rate and a temperature which mixes cold and hot water equally. If the water is supplied from an on demand heating device the water temperature supplied in this instance would be the middle of the temperature scale available;

FIG. 1*f* shows a user's hand 50 selecting a maximum flow rate and hot water only;

FIG. 2 shows a front view of a tile 1. The temperature and flow rate of the water is controlled by positioning a finger or toe anywhere within the proximity sensitive area 2 which operates in the same way as shown in FIG. 1;

FIG. 3 shows a front view of a tile with temperature and flow control surface with on off mechanisms. The temperature and flow rate of the water is controlled by positioning a finger or toe anywhere within the proximity sensitive area 2 which operates in the same way as in FIG. 1. The button 3 will turn the water on at the temperature and flow rate last selected by the user when used prior to the current operation of the unit. The off button 4 records the current temperature and flow rate selected by the user then turns the flow of water off.

Figure 4:
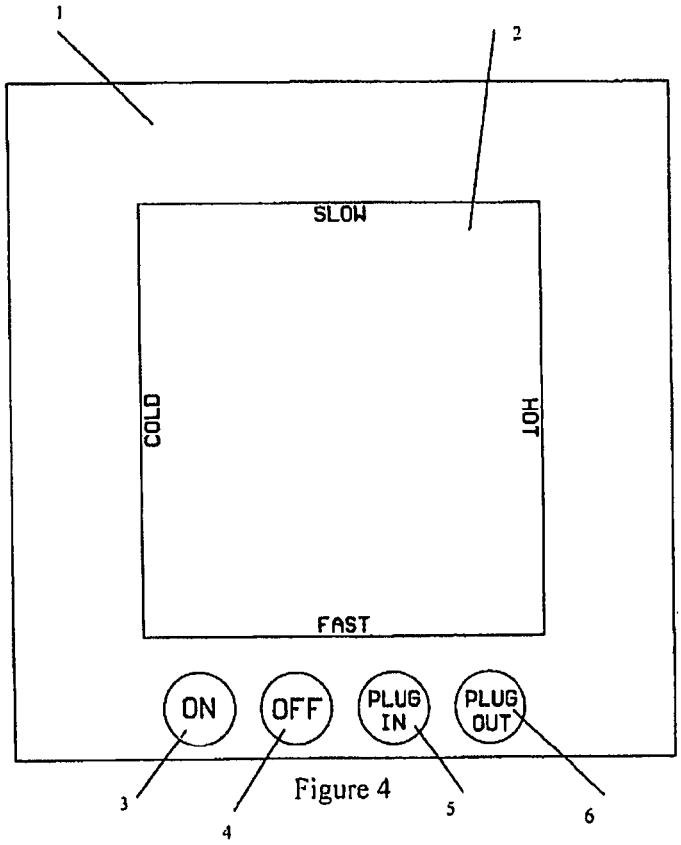
FIG. 4 shows a front view of a tile incorporating temperature, flow rate, on/off and plug in/out indications.

FIG. 4 shows a front view of a tile with temperature and flow rate control surface, on off mechanisms and plug in and plug out control mechanisms which can be positioned amongst other tiles on a wall for example. The temperature and flow rate of the water is controlled by positioning a finger or toe anywhere within the proximity sensitive area 2. The device can be turned on by touching the proximity sensitive area 2. The button 3 will turn the water on at the temperature and flow rate last selected by the user before turning the unit off. The off button 4 records the current temperature and flow rate selected by the user then turns the flow of water off. The plug in button 5 pulls the plug into the plug hole in order to block the flow of water from draining out of a bath or basin for example. The button plug out 6 will push the plug out of the plug hole so that water can drain out of a bath or basin for example.

Figure 5:
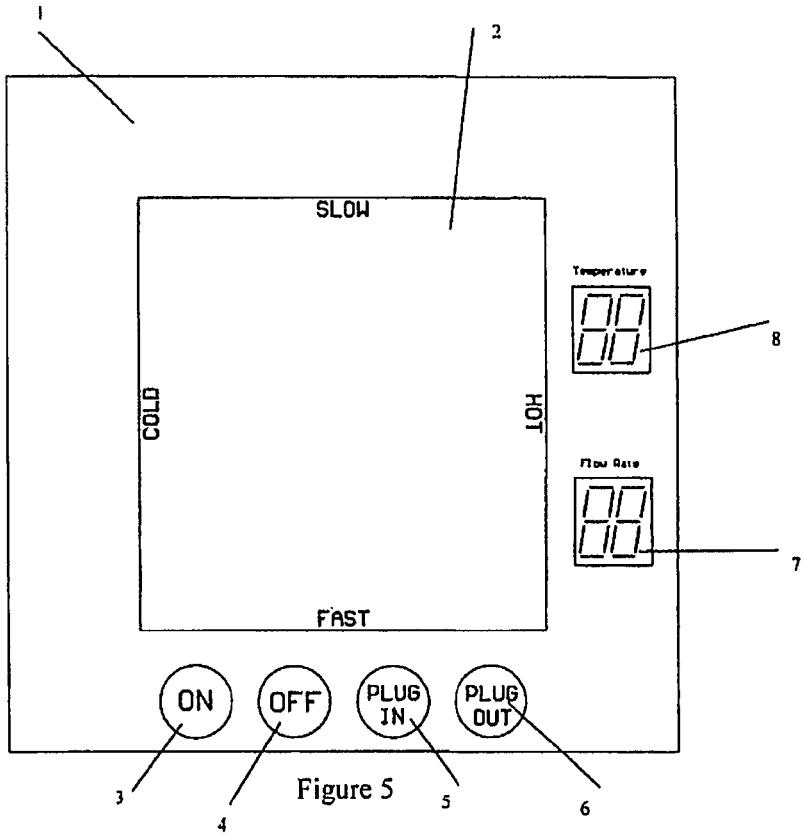
FIG. 5 shows a front view of a tile incorporating temperature, flow rate, on/off and plug in/out indications and temperature and flow rate displays.

FIG. 5 shows a front view of a tile 1 temperature and flow rate control surface, on 3 and off 4 mechanisms, plug in 5 and plug out 6 control mechanisms and temperature 8 and flow rate 7 displays. The temperature indicator 8 will show the temperature of the water currently selected. A flow rate indicator 7 which shows the flow rate of the water as a percentage for example from 00 to 99 where 00 indicates no flow and 99 indicates full flow.

Figure 6:
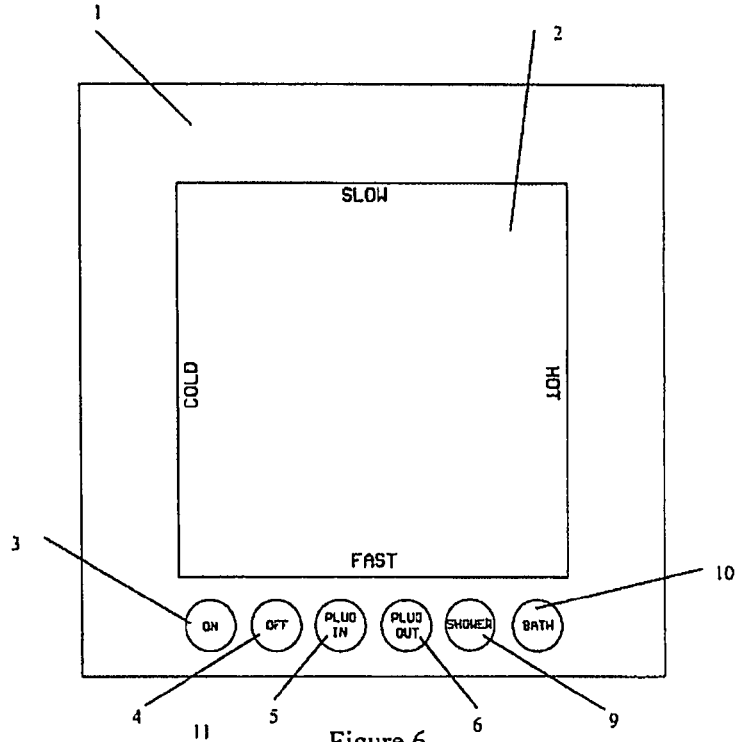
FIG. 6 shows a front view of a tile incorporating temperature, flow rate, on/off, plug in/out and shower/bath indications and temperature and flow rate displays.

FIG. 6 shows a front view of a tile 1 temperature and flow rate control surface which could be used to control a bath and shower system. On 3 and off 4 mechanisms are present. Plug in 5 and plug out 6 control mechanisms are present. Shower 9 or bath 10 selections can also be made which allows the user to control the water in a shower or bath.

Figure 7:
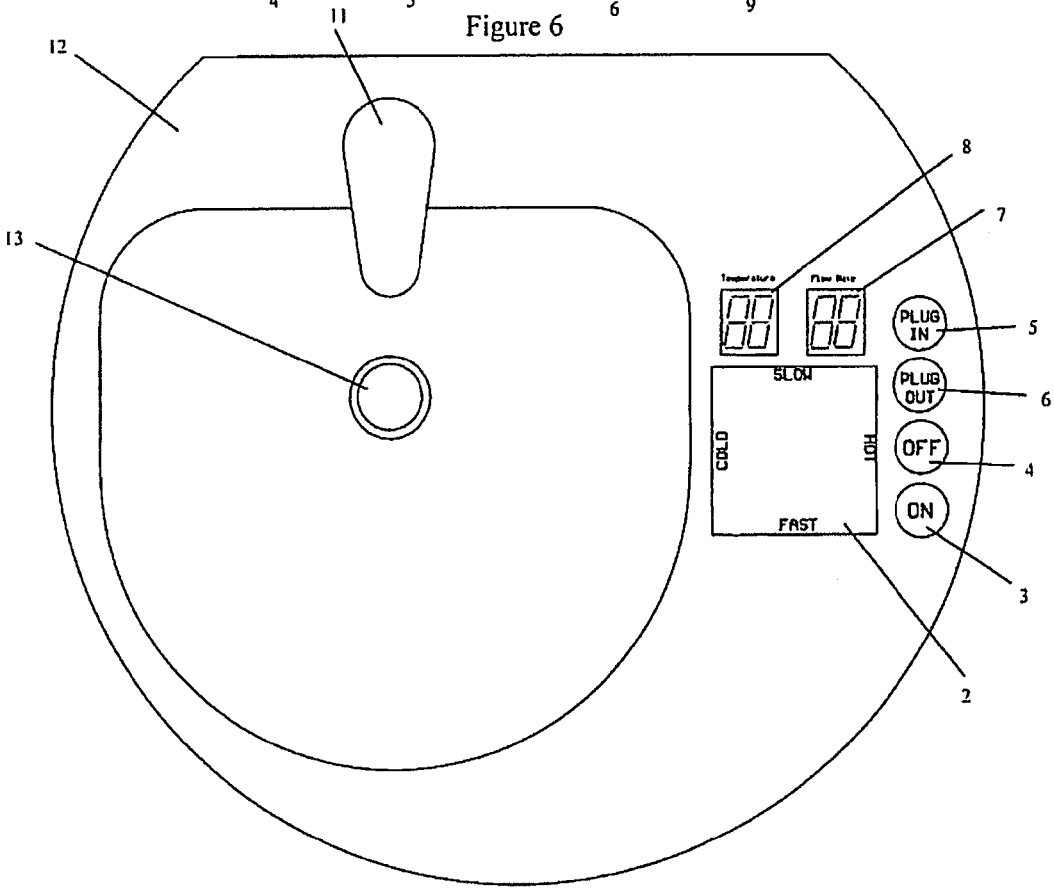
FIG. 7 shows a top view of a basin incorporating a proximity-sensitive device.

FIG. 7 shows a top view of a basin 12 with a single faucet 11, temperature and flow rate control surface 2, on 3 and off 4 mechanisms, plug in 5 and plug out 6 control mechanisms and temperature 8 and flow rate 7 displays. A single faucet 11 is shown which delivers the mixed hot and cold water or temperature controlled water to the basin. The temperature and flow rate of the water is controlled by touching the proximity sensitive area 2 which operates in the same way as in FIG. 1. A plug hole 13 is controlled by the buttons 6 and 5 which pushes the plug out or pulls the plug in respectively. The temperature is indicated by the display 8, and the flow rate is indicated by the display 7. An on button 3 turns the water on at the last temperature and flow rate selected from the previous use, and the off button 4 records the current temperature and flow rate selected by the user then turns the flow of water off.

Figure 8:
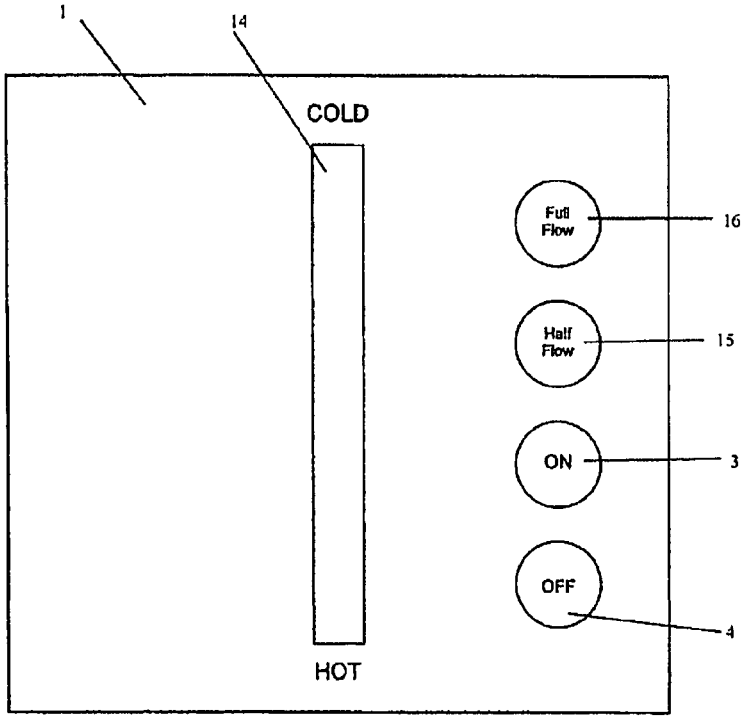
FIG. 8 shows a front view of a tile incorporating a variable water temperature controller as a single strip.

FIG. 8 shows the front view of a tile 1 which has a variable water temperature controller as a single strip 2. If the strip is touched at the top the water temperature will be cold. If touched at the bottom the water temperature will be hot. In between the top and bottom will produce a temperature which is a mixture of hot and cold according to the location of the touch. The full flow button 16 will output the water at maximum flow rate. The half flow button 15 will output the water at half the maximum flow rate. The on button 3 will turn the water flow on at the last temperature and flow rate selected from a previous use. The off button 4 will turn the water flow off.

Figure 9:
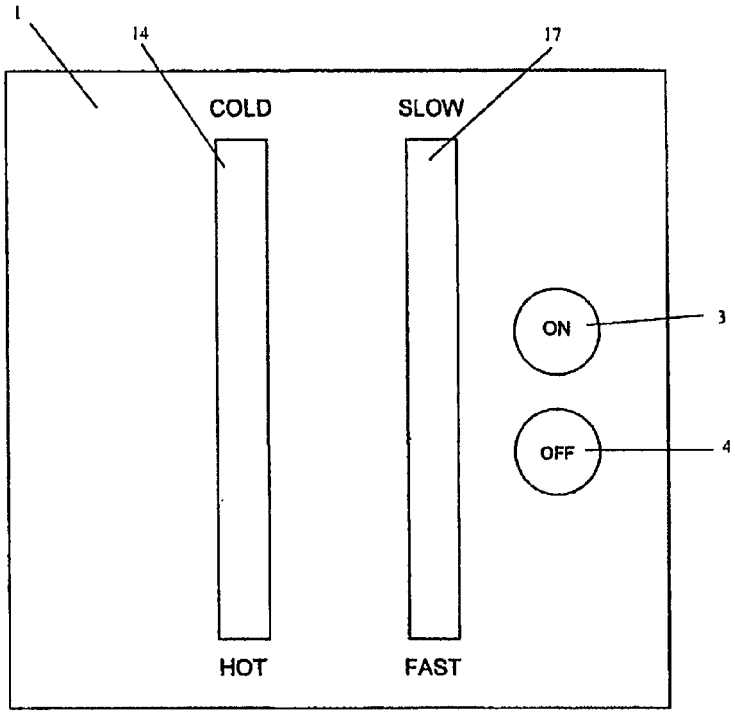
FIG. 9 shows a front view of a tile incorporating a variable water temperature controller as a single strip and a water flow rate controller as a single strip.

FIG. 9 shows the front view of a tile 1 which has a variable water temperature controller as a single strip 2. If the strip is touched at the top the water temperature will be cold. If touched at the bottom the water temperature will be hot. In between the top and bottom will produce a temperature which is a mixture of hot and cold according to the location of the touch. The water flow rate is controlled by a single strip 17. If touched at the top the flow rate will be low. If touched at the bottom the flow rate will be fast. In between the top and bottom will produce a flow rate which is a proportion of the slow and fast flow rate according to the position touched. The on button 3 will turn the water flow on at the last temperature and flow rate selected from a previous use. The off button 4 records the current temperature and flow rate selected by the user then turns the flow of water off.

Figure 10:
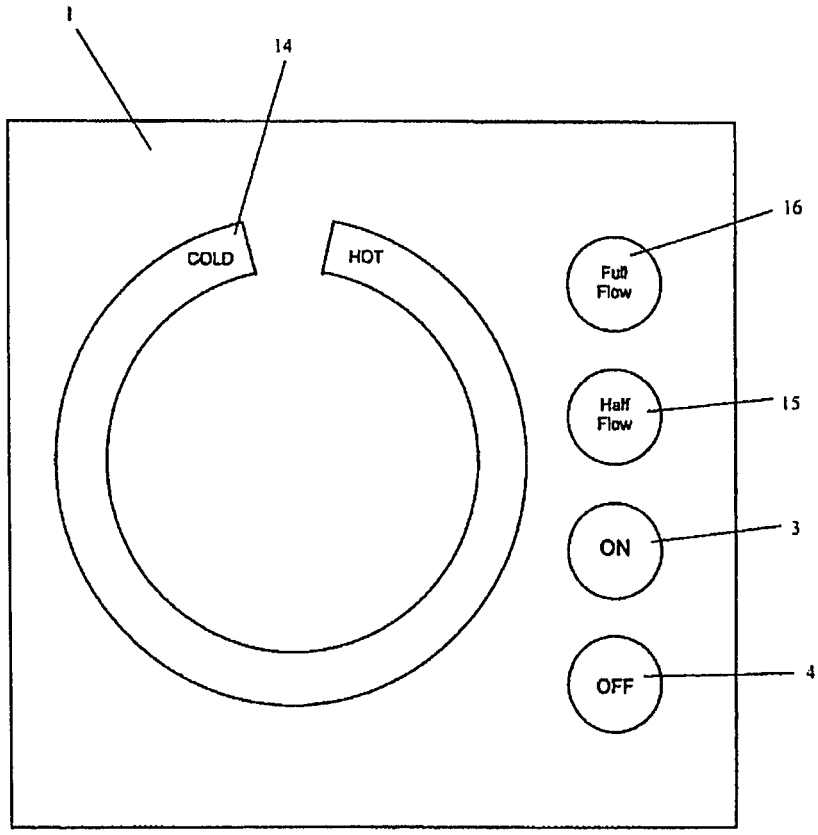
FIG. 10 shows a front view of a tile which has a variable water temperature controller as a single strip in the shape of an almost complete circle

FIG. 10 shows the front view of a tile 1 which has a variable water temperature controller as a single strip 2 in the shape of an almost complete circle. Touching the device in between the cold and hot markings will produce a temperature which is a mixture of hot and cold according to the location of the touch. The full flow button 16 will output the water at maximum flow rate. The half flow button 15 will output the water at half the maximum flow rate. The on button 3 will turn the water flow on at the last temperature and flow rate selected. The off button 4 records the current temperature and flow rate selected by the user then turns the flow of water off.

Figure 11:
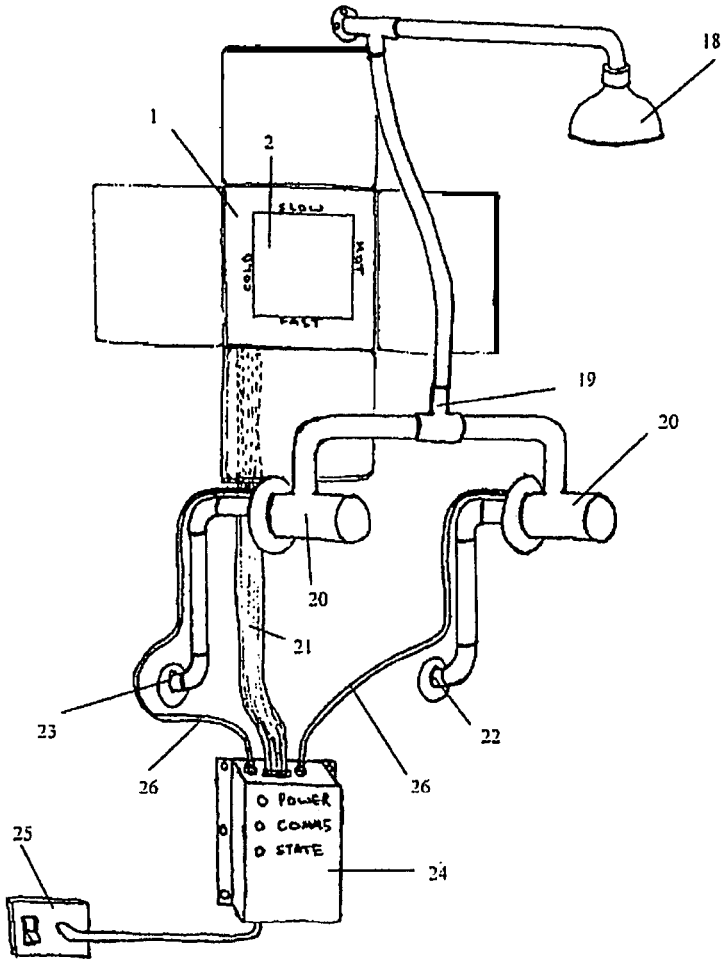
FIG. 11 shows a system used for operating a shower.

FIG. 11 shows a system used for operating a shower. The proximity sensitive device 1 can be positioned amongst other tiles as shown. In this instance it is connected to the main control device 24 via cable 21 which can be mounted behind tiles during retiling. The control box is powered from a mains power supply 25. Touching the tile anywhere in the proximity sensitive area 2 will instruct the control box 24 to adjust the electrically controlled variable valves 20 to open to a calculated amount according to the position. This will output water through the shower head 18 at the requested temperature and flow rate. The control lines 26 which operate the valves supply power and send back positional feedback to the main controller 24. Cold water comes in on pipe 23 and hot water enters on pipe 22. The hot and cold water combine after the output from the valves 20 and travel up pipe 19 to be dispensed through the shower head 18.

Figure 12:
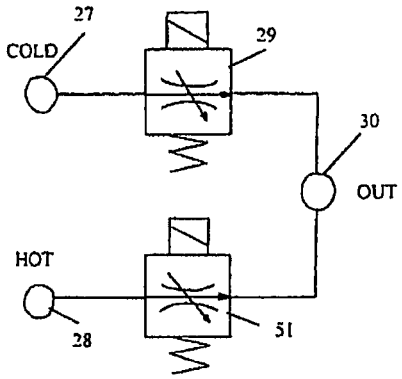
FIG. 12 shows a schematic of the fluid control system in FIG. 11.

FIG. 12 shows a schematic of the fluid control system in FIG. 11. Cold water enters the system at 27 and travels to one side of the electrically controlled variable valve 29 which is output at 30. Hot water enters the system at 28 and travels through an electrically controlled variable valve 51 which is output to 30. The hot and cold water mix and are output at position 30.

Figure 13:
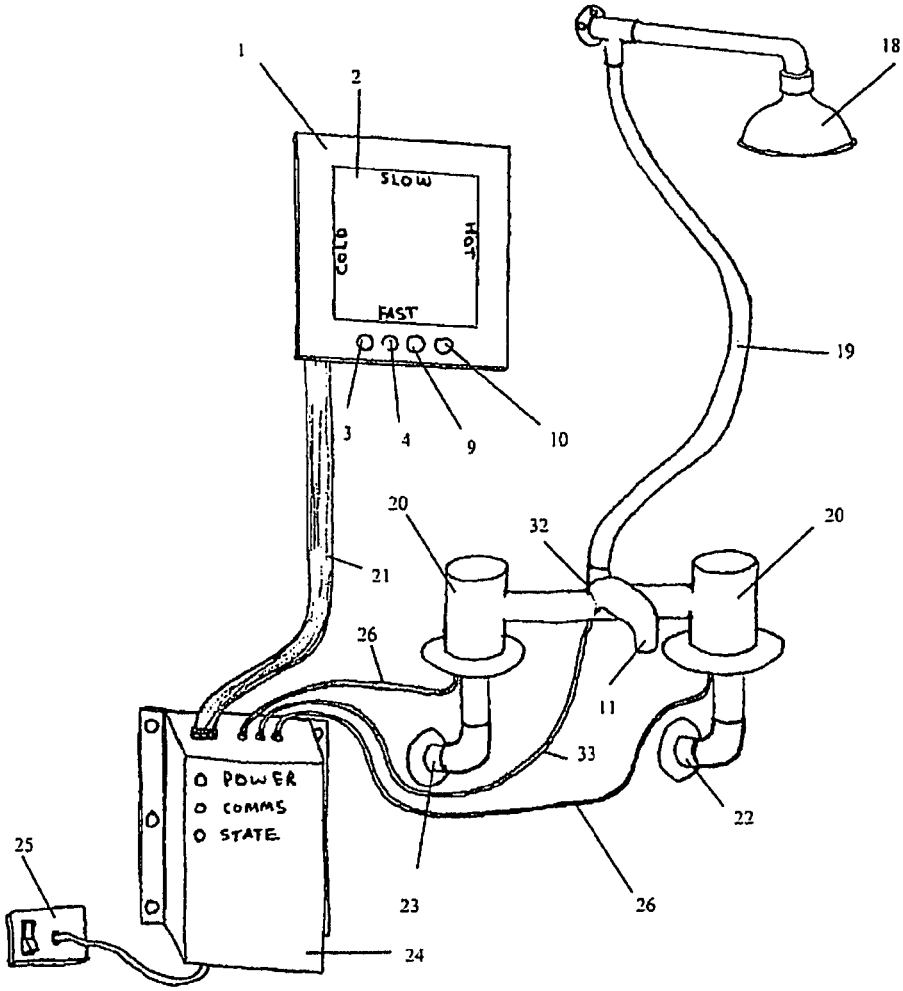
FIG. 13 shows a system where one proximity sensitive device 1 controls a shower and bath

FIG. 13 shows a system where one proximity, sensitive device 1 controls a shower and bath. The proximity sensitive tile controls a 3 connection 2 position solenoid valve 32 which controls whether the mixed water flows to the shower head 18 through pipe 19 when SHOWER button 9 is activated, or through the faucet 11 when BATH button 10 is activated. The water temperature and pressure is controlled by the proximity sensitive area 2 which communicates to the main control box 24 via cable 21. This will instruct the control box 24 to adjust the electrically controlled variable valves 20 though the cables 26 to open to a calculated amount according to the position of the finger or toe within the proximity sensitive area. Cold water comes in on pipe 23 and hot water enters on pipe 22.

Figure 14:
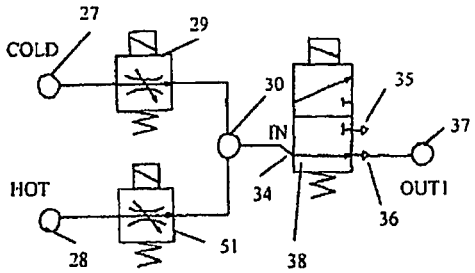
FIG. 14 shows a schematic of the fluid control system in FIG. 13 in a first operating mode.
Figure 15:
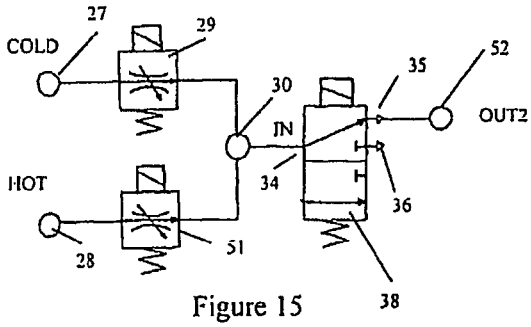
FIG. 15 shows a schematic of the fluid control system in FIG. 13 in a second operating mode.

FIGS. 14 and 15 show the schematic of the fluid control system in FIG. 13. Cold water enters the system at 27 and travels to one side of the electrically controlled variable valve 29 which is output at 30. Hot water enters the system at 28 and travels through an electrically controlled variable valve 51 which is output to 30. The hot and cold water mix and are output at position 30. The mixed water is then enters the electrically controlled 3 connection 2 position valve 38 through the input 34. The water is then directed to output OUT1 37 or to OUT2 52 which can be represented by faucet 11 or shower head 18 in FIG. 13 for example.

Figure 16:
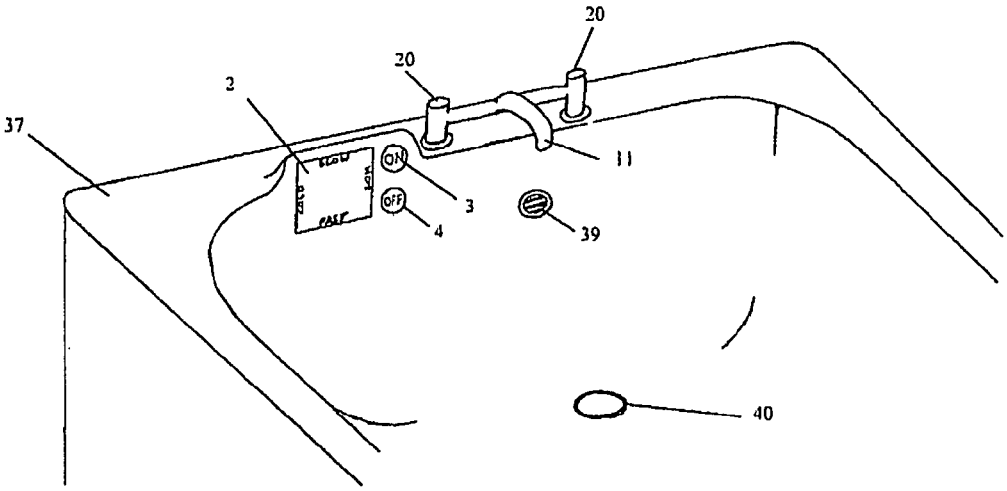
FIG. 16 shows a bath incorporating a proximity-sensitive fluid control system.
Figure 17:
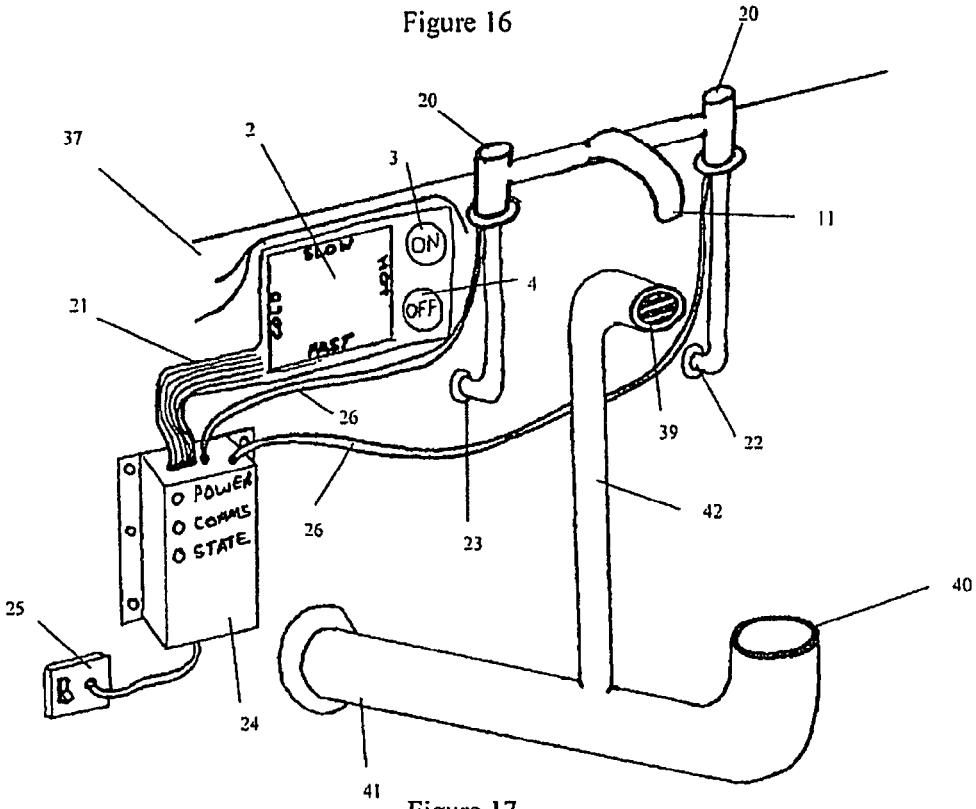
FIG. 17 shows a proximity sensitive fluid control system that can be used to operate the bath of FIG. 16.

FIGS. 16 and 17 show a proximity sensitive fluid control system that can be used to operate a bath 37. The proximity sensitive area 2 and buttons 3 and 4 communicates with the control box 24 via cable 21. Power is supplied to the control box from the mains power supply 25. The proximity sensitive device 1 will instruct the control box 24 to adjust the electrically controlled variable valves 20 though the cables 26 to open to a calculated amount according to the position of the finger or toe within the proximity sensitive area. The ON button 3 when activated turns the water flow on at the last temperature and flow rate the system was set to. The OFF button when activated records the temperature and flow rate currently set, then turns the flow of water off. Cold water comes in on pipe 23 and hot water enters on pipe 22 and are output as a mixture through faucet 11. The drainage of the bath is accomplished by the piping comprising overflow inlet 39, drain inlet 40, main drain pipe 41 and overflow pipe 42. The schematic of this fluid system is explained in FIG. 12.

Figure 18:
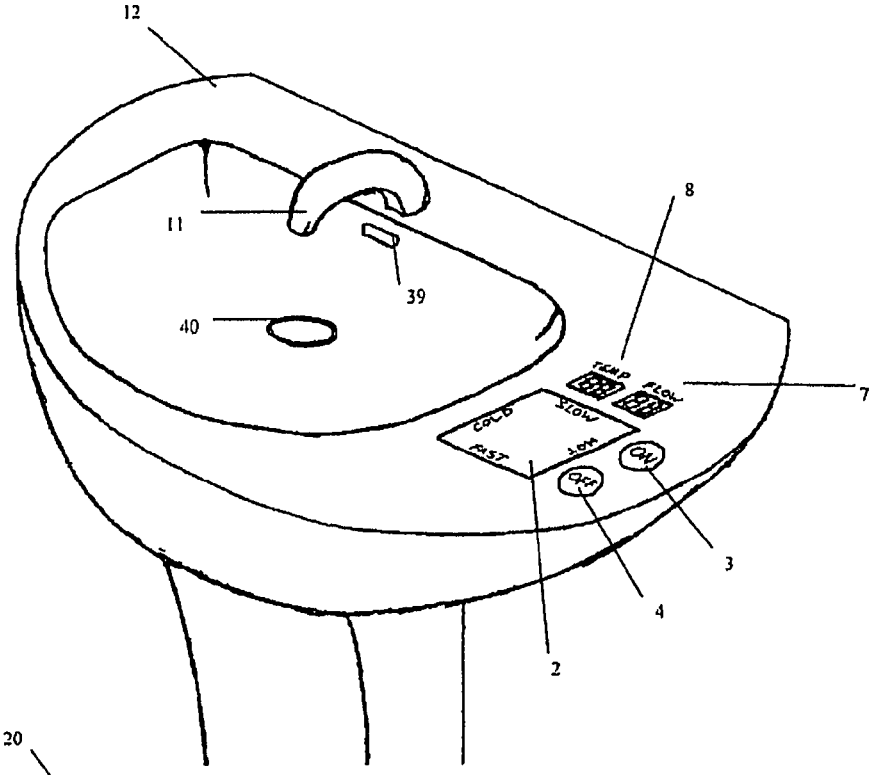
FIG. 18 shows a basin incorporating a proximity-sensitive fluid control system.
Figure 19:
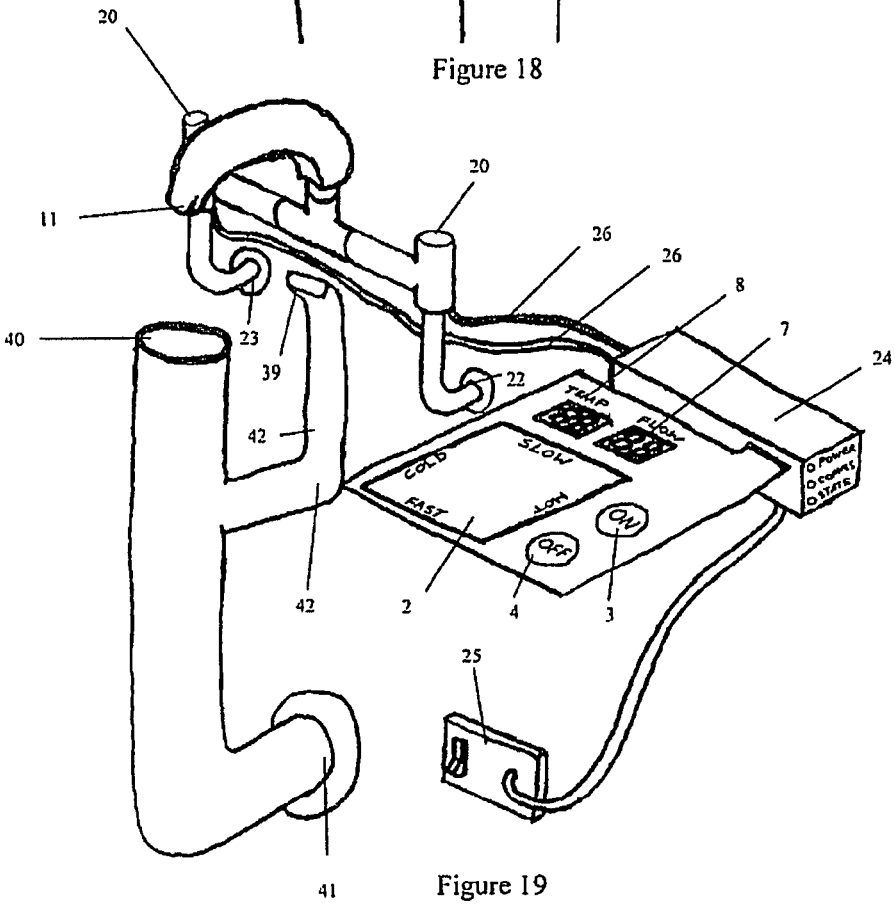
FIG. 19 shows a proximity sensitive fluid control system that can be used to operate the basin of FIG. 18 or a kitchen sink.

FIGS. 18 and 19 show a proximity sensitive fluid control system that can be used to operate a basin or kitchen sink 12. This fluid system is the same as in FIG. 17 except the proximity sensitive control device also incorporates a temperature display 8 and flow rate display 7. The temperature can be displayed in degrees celcius or degrees fahrenheit and the flow rate is displayed between 0 and 99, 0 indicating no flow and 99 indicating maximum flow. The schematic of this fluid system is explained in FIG. 12.

Figure 20:
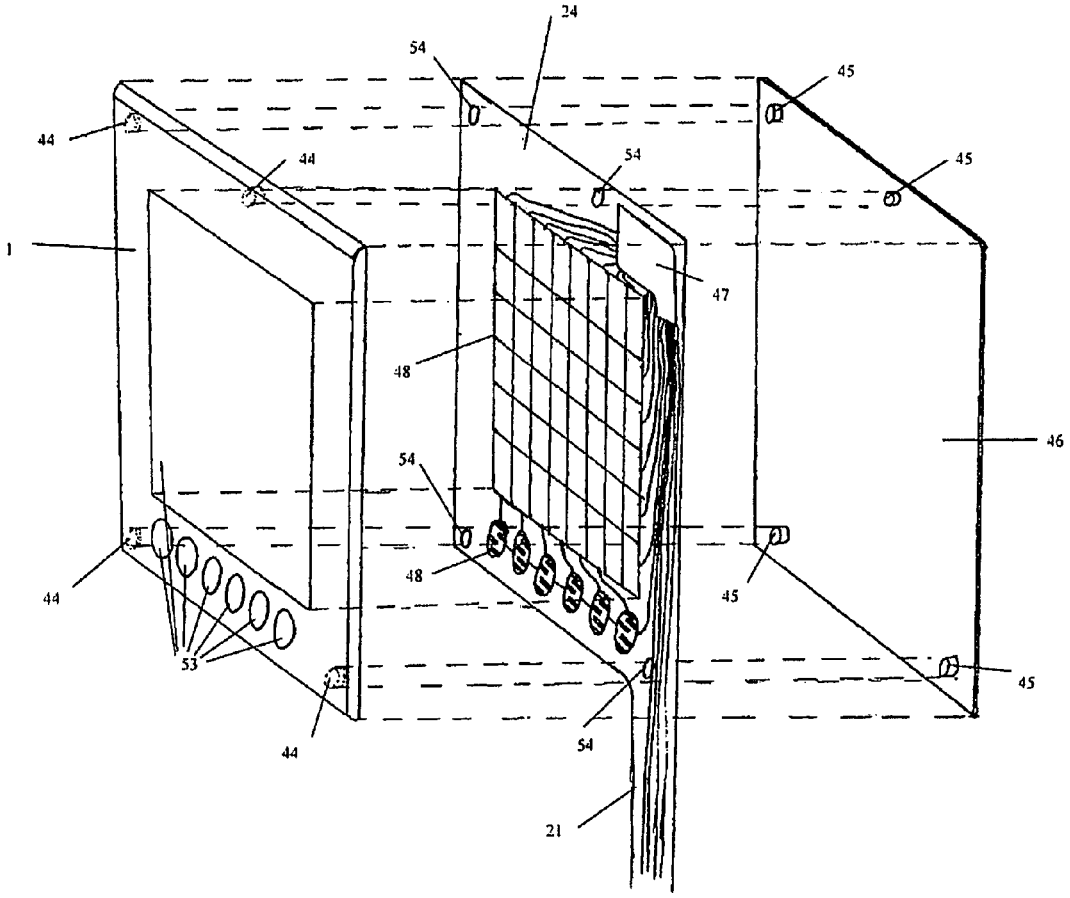
FIG. 20 shows an exploded view of an assembly for a tile integrated with a circuit board suitable for use in proximity-sensitive device.

FIG. 20 shows an exploded view of a possible assembly for a tile 1 integrated with a proximity sensitive circuit board 24. The tile 1 shows a pattern 53 printed on its surface indicating where specific proximity sensitive areas of the circuit board 24 are located. The tile 1 has 4 holes 44 on the reverse side of it for the positioning of the circuit board 24 and the back plate 46. The circuit board 24 for this example is preferably a flexi circuit board to keep the thickness to a minimum. The circuit board 24 has 4 holes 54 in it for positioning it correctly when the whole unit is assembled. The proximity sensitive area 48 is sensed by circuitry 47 and this information is communicated to the control box via cable 21. The back plate 46 covers the back of the assembled unit and uses mounting points 45 to help locate itself with the circuit board 24 into the tile 1. A water proof glue could be used to hold the assembled unit together.

The circuit board of FIG. 20 is also suitable for integrating into other devices, and may be scaled in size and the shape altered appropriately to suit the application. A proximity sensitive matrix to control the flow rate and temperature of water could be integrated into the faucet of a kitchen sink for example. The faucet in this description relates to the pipe from which water flows into a bath, basin or sink. The advantage of such a system would be the ability of the user to manipulate the faucet, if it was not fixed in place, to a desired position pivoting on its base for example, and control the flow rate and temperature with the same hand. The thumb of that hand for example could be used to select the desired flow rate and temperature while manipulating the faucet.

Figure 21:
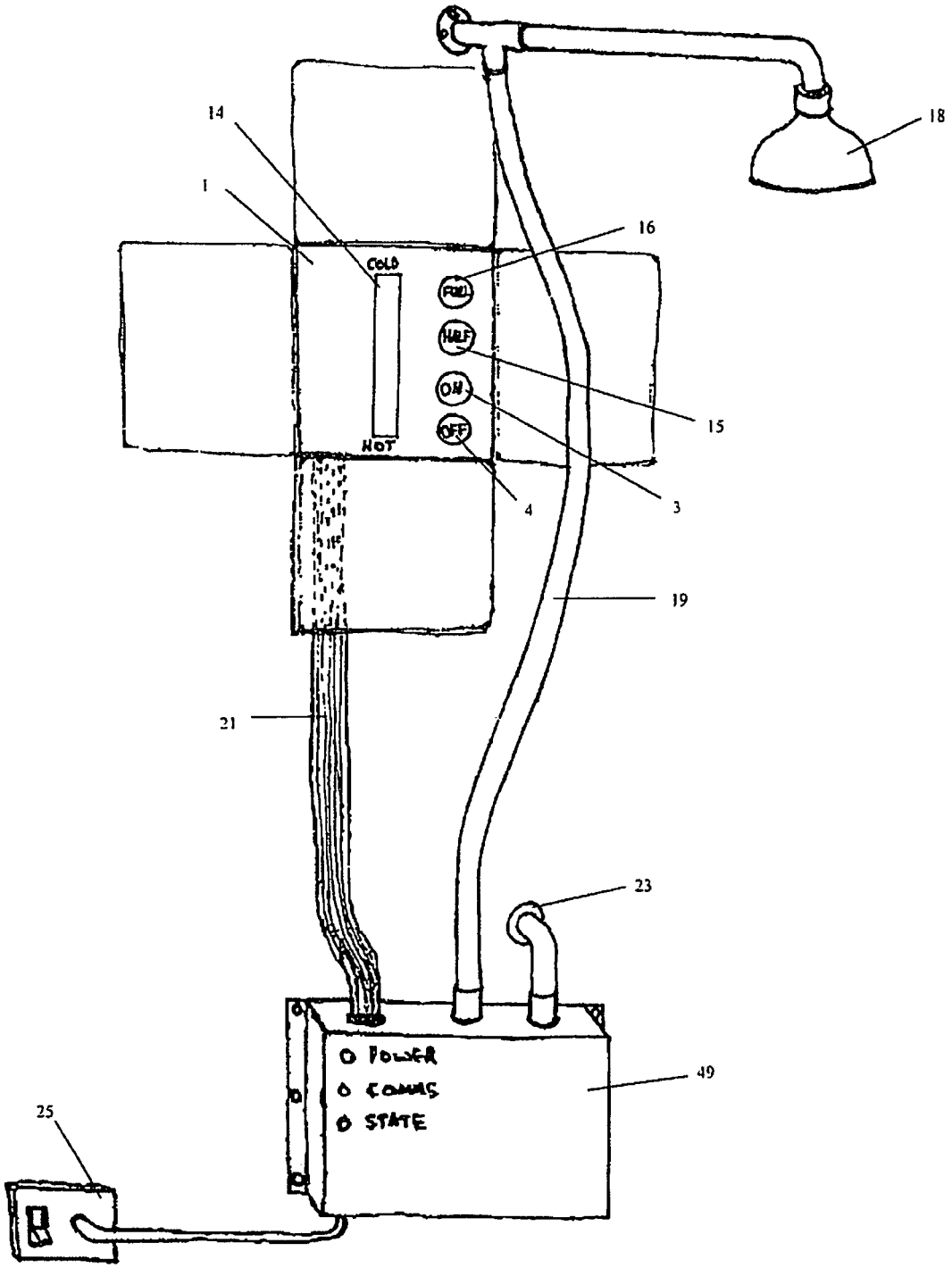
FIG. 21 shows a proximity-sensitive fluid control system that can be used to operate a hot water on demand shower system.

FIG. 21 shows a proximity sensitive fluid control system that can be used to operate a hot water on demand shower system. The proximity sensitive device 1 can be positioned amongst other tiles as shown. In this instance it is connected to the main control device 49 via cable 21 which can be mounted behind tiles during retiling. The control box is powered from a mains power supply 25. Touching the tile in the area indicated by 14 controls the water temperature between cold and hot. If button 16 is activated the water flow rate will be maximum. If button 15 is activated the water flow rate will be half the maximum flow rate available. The ON button 3 when activated turns the water flow on at the last temperature and flow rate the system was set to. The OFF button when activated records the temperature and flow rate currently set, then turns the flow of water off. Cold water comes in on pipe 23 and is input to the hot water on demand control box 49. This is then heated according to the temperature selected 14 and at the water flow rate selected by 16 or 15. The heated water is output to the shower head 18 from the control box using pipe 19.

Figure 22:
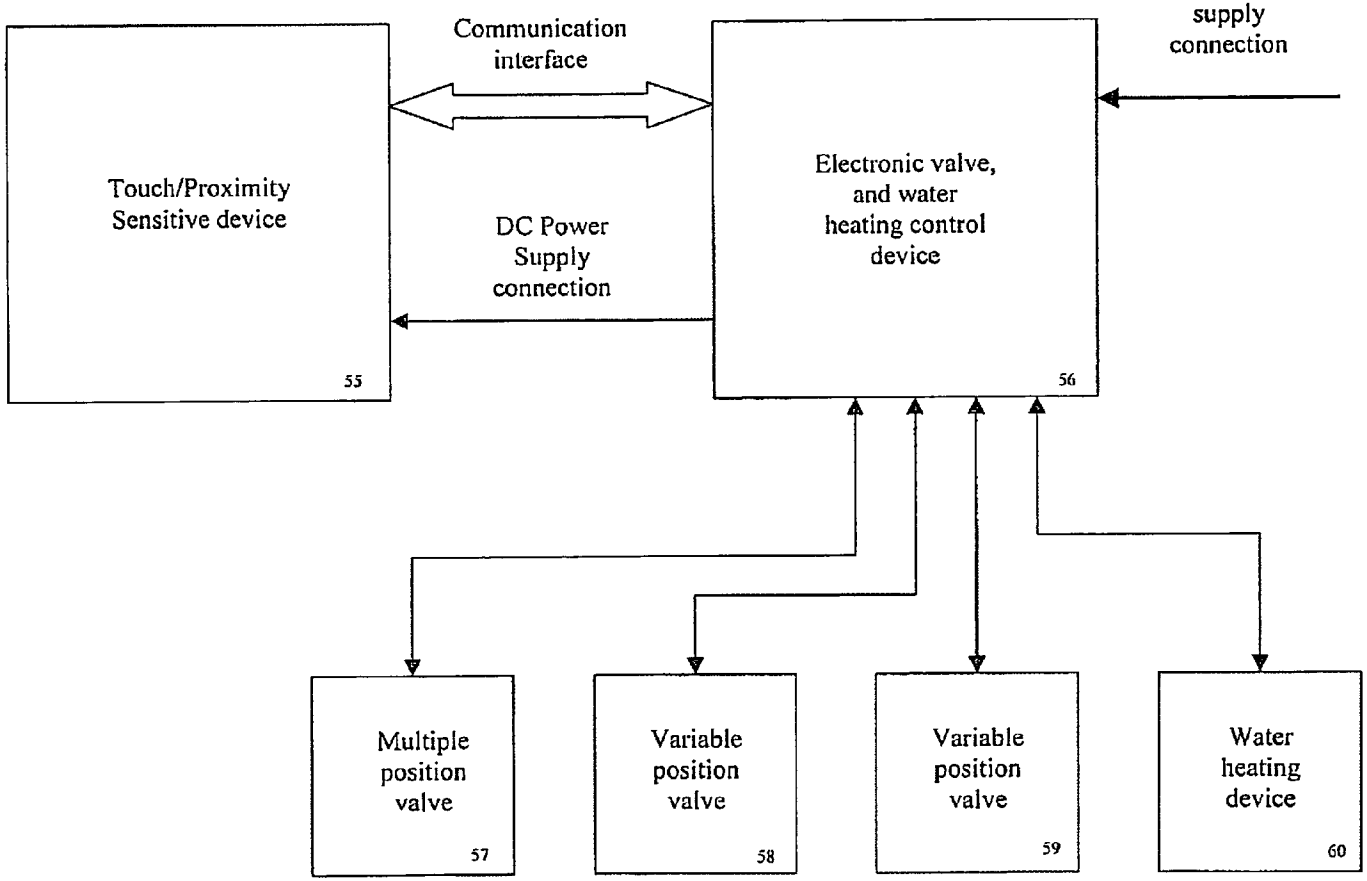
FIG. 22 shows a block diagram of electrical connections within a proximity-sensitive water control system.

FIG. 22 shows a block diagram of the electrical connections within a proximity sensitive water control system. The proximity sensitive device 55 is powered from the main electronic valve and water heating control device 56. The buttons which have been activated by a user are sent to the main control unit 56 via an electronic control interface which may be wired, wireless or optical. The main control unit 56 is capable of controlling electrically controlled multiple position valves 57, electrically controlled variable position valves 58 and 59 which could be used to control the flow of hot or cold water for example, and water heating devices 60 which could be used supply hot water on demand for a shower system.

Figure 23:
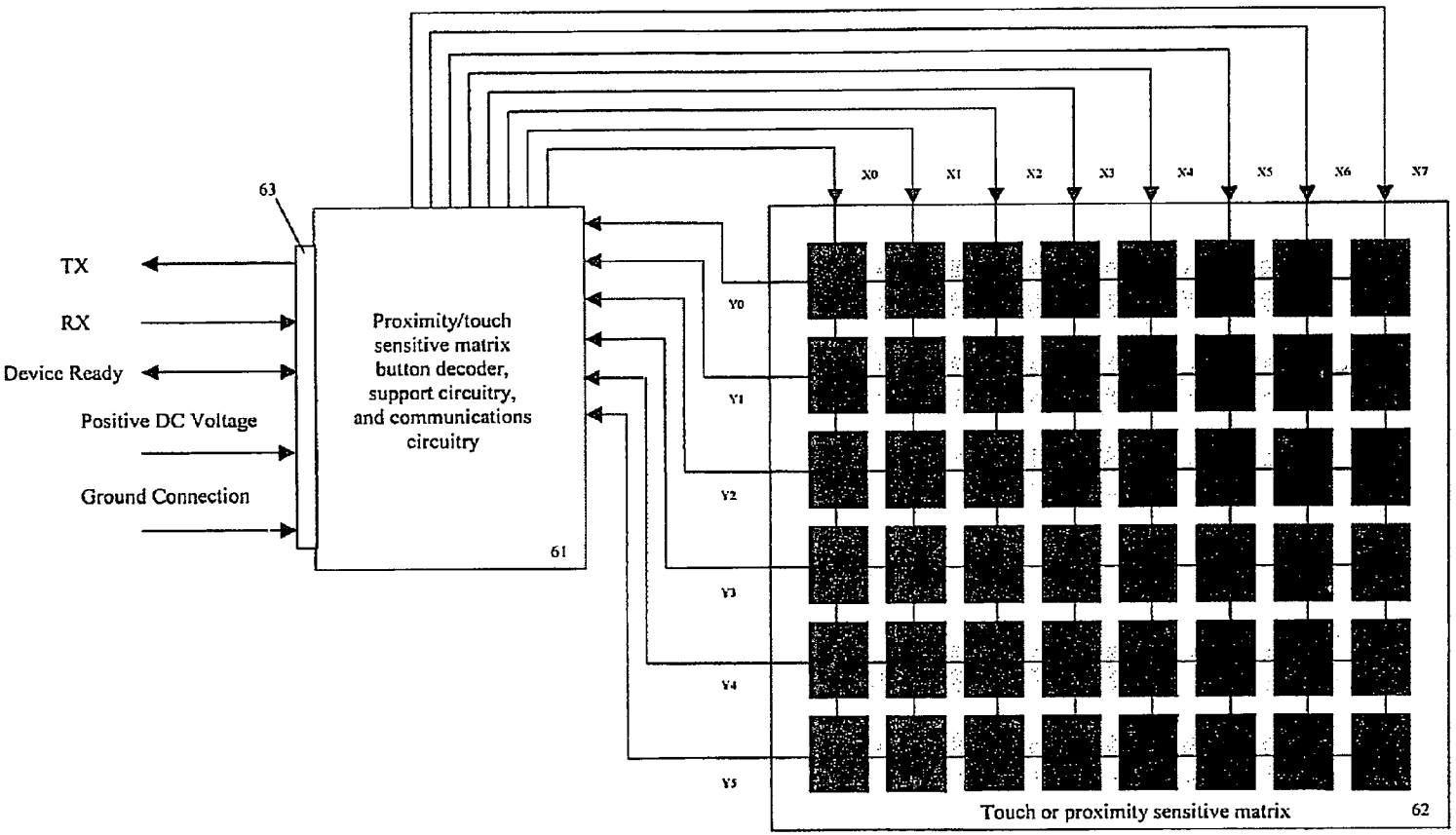
FIG. 23 shows a block diagram of a proximity-sensitive control device.

FIG. 23 shows a block diagram of a proximity sensitive control device. The proximity sensitive matrix 62 consists of forty eight buttons made up of six rows and eight columns. These buttons are decoded by the proximity sensitive button decoder 61 and the information is sent to the valve control unit via cable connection 63. The cable connection 63 also supplies a positive voltage and ground connection to the electronic circuitry 61.

FIG. 24 shows a block diagram of a proximity sensitive circuit. The proximity sensitive buttons are represented by 66 and 67. There are forty two buttons which make up the proximity sensitive matrix represented by 66 which could control the temperature and flow rate of water. There are six buttons represented by 67 which could be used individually to control specific functions such as ON, OFF, SHOWER SELECT, BATH SELECT, PLUG IN, PLUG OUT for example. The electronic device 64 is designed to detect human proximity using capacitive sensing technology which can detect the activation of up to forty eight individual buttons represented by 66 and 67. A suitable example for electronic device 64 is QT60486 and is manufactured by Quantum Research Group. The datasheet may be obtained from www.qprox.com and is incorporated herein by reference. The digital communications interface device 65 is a standard interface device which is used in this instance to interface device 64 to a valve control device through connector 68. A suitable example for device 65 is MAX3232CUE and is manufactured by Maxim Semiconductor, and several other manufacturers make similar devices.

The system is controlled by a processor incorporated in the control box. This may communicate with the proximity sensitive circuit using the RS232 interface. The processor may be part of a microcontroller, which contains built-in I/O interfaces such as RS232, pulse width modulators for controlling electrical motors which may be found in electronically controlled valves, built-in RAM and built-in ROM, which may be one-time programmable or electrically erasable. Examples include the PIC series of microcontrollers, available from Microchip Technology Inc.

Preferably the processor is located in the control box and connects to the proximity-sensitive device and the valve control unit by RS232. Alternatively the processor could be located with the proximity-sensitive device or the valve control unit. If it is located within the valve control unit it may interface with the electronically controlled valves through the use of analog support circuitry such as direct current or stepper motor control circuitry. The analog circuitry may translate the digital signals from the microcontroller into the correct voltage and current required by the electronically controlled valve to reach a position calculated by the microcontroller according to inputs received from the proximity sensitive circuit. The electronically controlled valve may send back its positional information to the microcontroller so that the microcontroller could decide when the calculated position had been reached and maintain that position until new information is received from the proximity sensitive device.

Interpolation between sensors can be used to increase the resolution that the user has to control the temperature and flow rate of water. This increase in resolution may be required if the number of sensors used to measure the position of a user is not enough to give the user a feeling of continuous temperature and flow control over the water supply which a user receives from mechanical tap control mechanisms. As an alternative method of providing substantially continuous variation, the number of sensors may be increased, but interpolation can achieve a similar effect with fewer sensors.

Discrete interpolation between two sensors is accomplished by sensing whether both sensors have been activated at the same time inferring that since both sensors are activated, the central position between the two sensors has been activated and therefore a virtual sensor between them has been created therefore increasing the resolution. For continuous variation, a comparison between sensitivity levels measured at both sensors can be made to determine which sensor the activation is proportionally closer to. An approximation can then be made as to the control position of this activation.

This interpolation can be extended to more than two sensors, where for example if four sensors were positioned in the form of a square, the discrete interpolated sensor between each pair of sensors could be determined as already explained and if all four sensors are activated at the same time it could be inferred that there is a discrete virtual sensor at the centre of all four sensors which has been activated. Continuous variation between each pair would operate as explained above between two individual sensors, and if all four sensors were activated, measuring all four sensor's sensitivity levels would determine which sensor the activation is proportionally closer to and the approximate control position of this activation can then be determined therefore increasing the resolution.

The following sequences are implemented using program code running on the processor; alternatively they could be implemented using dedicated hardware such as a finite state machine to process the incoming data from the proximity-sensitive device.

Figure 25:
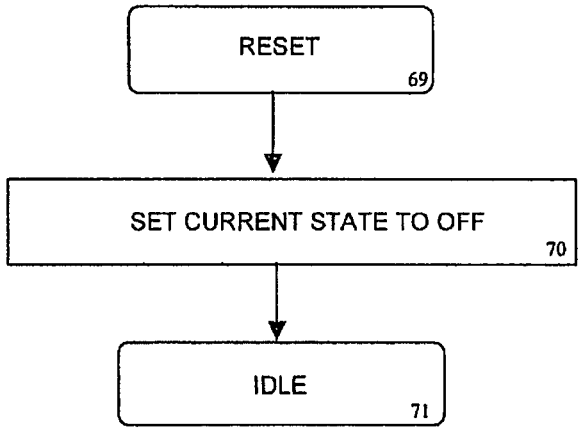
FIG. 25 shows a flowchart for a sequence that occurs after the control box has been turned on by a user.

FIG. 25 refers to the sequence that occurs after the control box has been turned on by a user. After the unit has been turned on it comes out of the RESET condition 69. The next phase after RESET is to set the current STATE to the OFF state 70. This insures no accidental activation during installation and is also the mode which is used to deactivate the control of the valves so that cleaning of the surface of the proximity sensitive device can be accomplished without activating the valves and turning on water flow. The control unit will then enter the IDLE state and continue looking for key activations 71.

Figure 26:
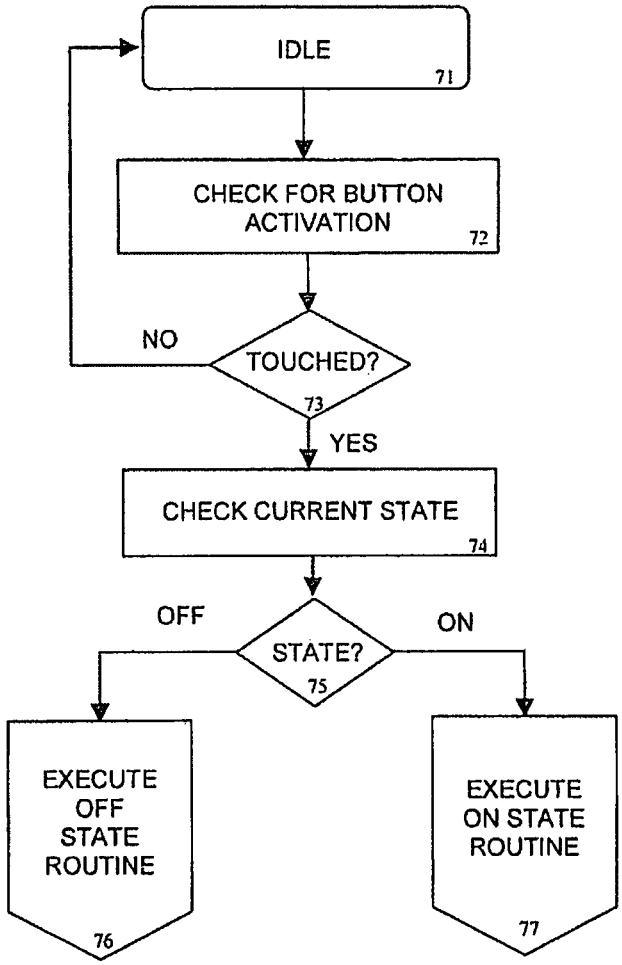
FIG. 26 shows a flowchart for a sequence that occurs while waiting for a key to be pressed.

FIG. 26 refers to the sequence that occurs while waiting for a key to be pressed. The routine continuously checks for any key activations 72. Once one or more keys have been activated 73 it checks whether the current state of the system is ON or OFF, 74 and 75 and then proceeds to execute either the OFF routine 76 or the ON routine 77.

Figure 27:
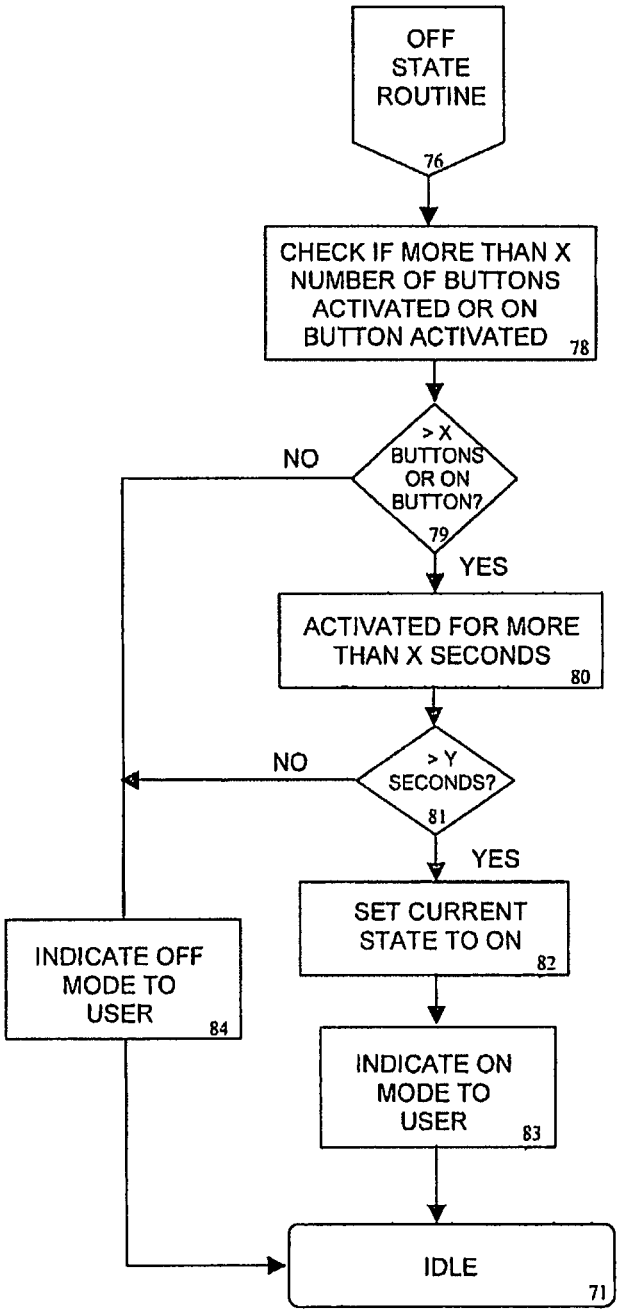
FIG. 27 shows a flowchart for an OFF state routine.

FIG. 27 refers to the OFF state routine 76. The first decision it makes is to determine if more than a minimum number of keys X have been activated or the ON button has been activated 78. If the minimum number of keys X or less have been activated or the ON button has not been activated 79, the OFF mode is indicated to the user 84 and the program returns to the IDLE routine 71. If more than a minimum number of keys X have been activated or the ON button has been activated 79 then it continues to check this for Y seconds 80. If this time is equal or less than Y seconds 81, the OFF mode is indicated to the user 84 and the program returns to the IDLE routine 71. If the time is greater than Y seconds 81, the mode is changed to ON 82 which is indicated to the user 83 and the program then returns to the IDLE routine 71.

Figure 28:
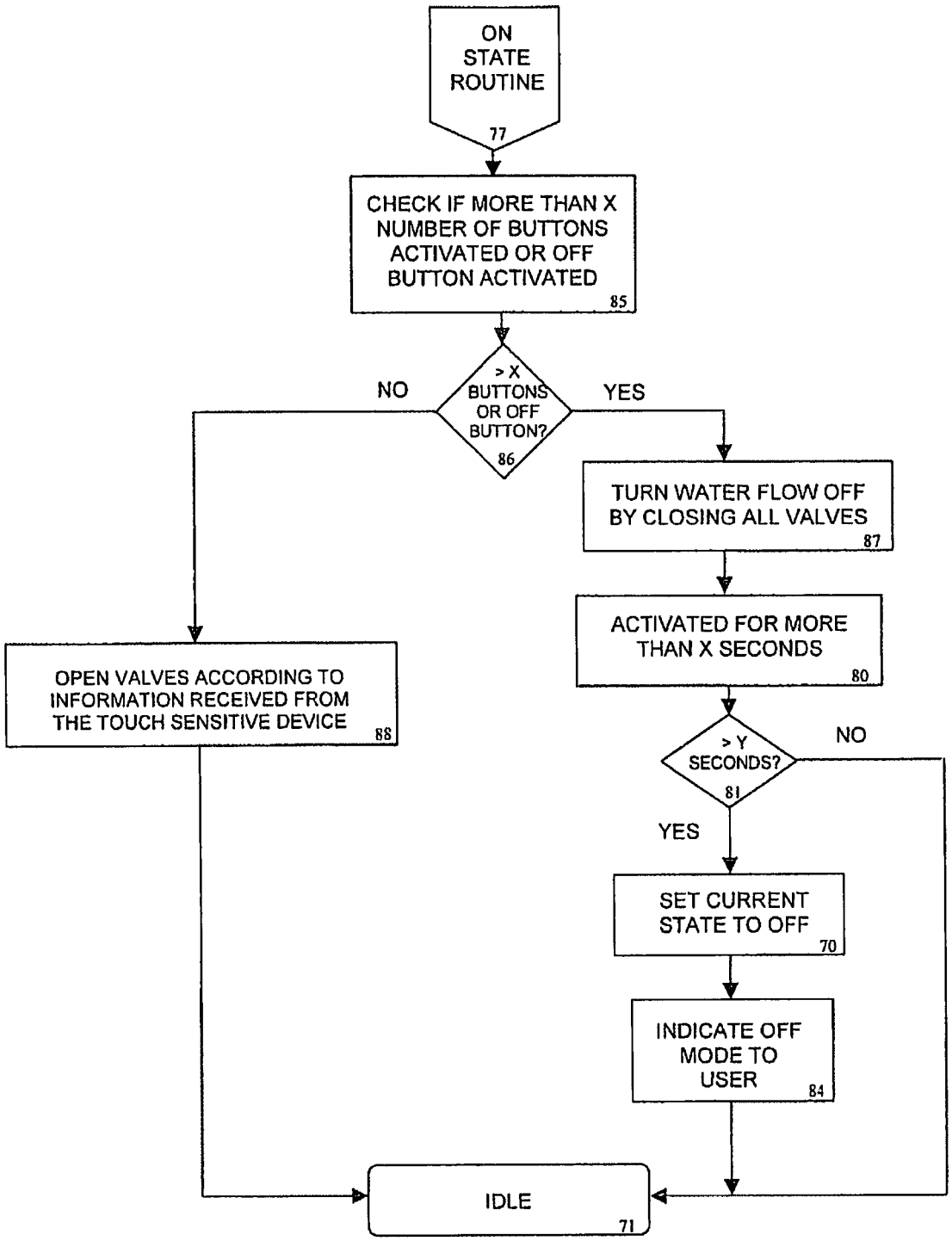
FIG. 28 shows a flowchart for an ON state routine.

FIG. 28 refers to the ON state routine 77. The first decision it makes is to determine if more than a minimum number of keys X have been activated or the OFF button has been activated 85. Appropriate values for X may depend upon the spacing of the proximity sensors in the matrix; for closely-spaced sensors a larger value of X may be required than for sensors spaced further apart. This value may be such that in normal operation, with the proximity-sensitive device controlled by the user's finger, it is not exceeded, but such that it will be exceeded by the user pressing a hand on the proximity-sensitive device. If the minimum number of keys X or less have been activated or the OFF button has not been pressed 86, the valves are opened according to the required temperature and flow rate selected by the user 88. The routine then returns the program to the IDLE state 71. If more than the minimum number of keys X have been activated or the OFF button has been activated 86, the valves are closed, turning off the water flow 87. If more than the minimum number of keys X have been activated or the OFF button has been activated for equal to or less than Y seconds 80 and 81, the program returns to the IDLE state 71. If the time is greater than Y seconds 80 and 81, the current state is changed to OFF 70 and the OFF mode is indicated to the user 84. Suitable values for Y may depend upon the application, but in general Y may be longer than the user would normally expect to rest their band on the proximity-sensitive device accidentally or inadvertently. The program then returns to the IDLE mode 71.

FIG. 29 represents an example of a 2 dimensional control surface as a table for translating the location of a persons proximity to the control device into water temperature and flow rate information. In this example the temperature is determined by the percentage mixture of hot and cold water. The table could instead incorporate temperatures rather than percentage mixtures of hot and cold water for example which could then be communicated to a heating apparatus which would then heat the water to the selected temperature.

The 2 dimensional control surface in this example is represented as a 7×4 matrix which is explained in the following paragraphs and shown in FIG. 29.

There are 4 rows numbered 1 to 4 and located on the Y axis with row 1 at the top and row 4 at the bottom where the Y axis controls the flow rate of the water with SLOW indicated at the top and FAST indicated at the bottom. Row 1 could represent 25% maximum possible flow rate, row 2 could represent 50% maximum possible flow rate, row 3 could represent 75% maximum possible flow rate and row 4 could represent 100% maximum possible flow rate. The linear change in flow rate represented by rows 1 to 4 is an example. Other rates of change, such as exponential change of water flow rates are also possible.

The seven columns numbered 1 to 7 are located on the X axis going left to right with COLD water indicated on the left and HOT water on the right. Column 1 would produce only cold water and column 7 only hot water at the flow rate assigned to its respective row number. The centre column, in this instance column 4 represents the equal mixing of hot and cold water, and when their percentages are combined it equals the percentage flow rate assigned to its respective row. The columns from 1 to 7 are shown to have a linear increase in hot water flow rate and a linear decrease in cold water flow rate as a percentage of the maximum flow rate assigned to its particular row, where the combination of the hot and cold water flow rate percentages equals the percentage of maximum flow rate assigned to its respective row. This linearity is used as an example. Other rates of change in water flow, such as exponential change are also possible.

Each position in the matrix shown in FIG. 29 contains a percentage value for hot and cold water of the fully open position for each valve. For example, if matrix position 2,2 (X,Y) was activated the controller would turn the cold water valve 41.67% open and the hot water valve 8.33% open.

Another possible method for controlling rates of change within each row is shown in FIG. 30. In this example the basis for controlling the flow rate is centred around having the maximum flow rate for each respective row relate to hot and cold water flow rates individually, rather than a combination of their flow rates. Therefore the centre column, in this instance column 4 allows the user to have equal maximum flow rates for each valve at the maximum flow rate assigned to its respective row. This means the flow rate along a particular row would not be constant, but the temperature would be the same for each respective column since the ratio of the hot and cold water mixture would remain the same along the length of each respective column. For example, matrix location 4,3 (X,Y) in FIG. 30 has a maximum flow rate assigned to the row of 75% and therefore being the centre column with equal mixing of hot and cold water, the cold water flow rate is 75% of the maximum flow rate and the hot water flow rate is also 75% of the maximum flow rate.

Using discrete interpolation the matrix could be expanded from a 7×4 matrix of sensors to a 13×7 matrix of sensors. This increase in resolution would give the user a greater ability to select the temperature and flow rate they require. Using continuous variation interpolation the nature of the touch sensitive device approaches that of the mechanical tap in terms of giving the user far greater control over the temperature and flow rate of water.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A method of controlling water temperature and flow rate characteristics of a shower or faucet, the method comprising:

sensing the proximity of a user in two dimensions using a two-dimensional control surface;

determining a position of the user using an electronic controller;

controlling the temperature and flow rate of the water responsive to said position of the user using one or more electronically controllable valves coupled to said controller said valves having at least an input for a cold water pipe and an output coupled to a head of the shower or faucet; and wherein said determining of said position of the user comprises sensing with a two-dimensional control surface comprising a plurality of sensors, two or more of said plurality of sensors each having an activated state and a non-activated state, said activated state comprising a plurality of sensitivity levels, and measuring sensitivity levels at two or more of said sensors, and interpolating using said controller, based on said measured levels, to determine an interpolated user position, said sensitivity levels being for determining which sensor the position is proportionally closer to wherein said interpolated user position along a first axis of said control surface determines the water temperature, and the said interpolated position along a second axis of said control surface determines the water flow rate;

translating said interpolated user positions along said first and second axis into water temperature and flow rate information by using said interpolated user positions along said first and second axis to X-Y address a lookup table wherein values in said lookup table define a water temperature and flow rate response of said control apparatus to said interpolated user position;

such that both the temperature and flow rate of the water are definable by a single touch of the user; the method further comprising:

using a plurality of lookup table configurations for allowing said user to define a plurality of said temperature and flow rate combinations; and providing user feedback telling the user one or both of said water temperature and said water flow rate.

2. A method according to claim 1, wherein said controlling the temperature and flow rate of the water responsive to said position of the user comprises controlling two said electronically controllable valves responsive to said position of the user.

3. A method according to claim 1, wherein said controlling the temperature and flow rate of the water responsive to said position of the user comprises controlling a heater responsive to said position of the user.

* * * * *